428-408
7/17/84 XR 4,460,060 SR

United States Patent [19]

Hasumi et al.

[11] Patent Number: 4,460,060

[45] Date of Patent: Jul. 17, 1984

[54] VIBRATORY DIAPHRAGM FOR LOUDSPEAKER

[75] Inventors: Shigeru Hasumi, Otsu; Kazuo Tanaka; Takashi Nishidoi, both of Shiga, all of Japan

[73] Assignee: Toray Industries, Inc., Tokyo, Japan

[21] Appl. No.: 480,476

[22] PCT Filed: Aug. 27, 1981

[86] PCT No.: PCT/JP81/00195

§ 371 Date: Mar. 29, 1983

§ 102(e) Date: Mar. 29, 1983

[87] PCT Pub. No.: WO83/00791

PCT Pub. Date: Mar. 3, 1983

[30] Foreign Application Priority Data

Mar. 7, 1980 [JP] Japan ..... 55-27894

[51] Int. Cl.[3] ..... G10K 13/00; H04R 7/04; H04R 7/10

[52] U.S. Cl. ..... 181/169; 179/181 R; 181/170; 428/224; 428/251; 428/252; 428/283; 428/284; 428/285; 428/287; 428/337; 428/339; 428/408; 428/902

[58] Field of Search ..... 179/181 R; 181/169, 181/170; 428/224, 251, 252, 283, 284, 285, 287, 337, 339, 408, 902

[56] References Cited

U.S. PATENT DOCUMENTS

| | | | |
|---|---|---|---|
| 3,930,130 | 12/1975 | Boszor | 179/181 R |
| 3,935,924 | 2/1976 | Nagao et al. | 181/169 |
| 4,076,098 | 2/1978 | Ward | 181/169 |
| 4,281,223 | 7/1981 | Vgaji et al. | 181/170 |
| 4,291,781 | 9/1981 | Niguchi | 181/169 |
| 4,315,557 | 2/1982 | Nakoya et al. | 181/169 |
| 4,342,803 | 8/1982 | Stengle | 428/244 |
| 4,359,132 | 11/1982 | Parker et al. | 181/169 |
| 4,410,768 | 10/1983 | Nakamura et al. | 181/169 |

FOREIGN PATENT DOCUMENTS

| | | | |
|---|---|---|---|
| 52-65421 | 5/1977 | Japan | 181/169 |
| 54-127318 | 10/1979 | Japan | 181/169 |
| 54-155825 | 12/1979 | Japan | 181/169 |
| 55-3240 | 1/1980 | Japan | 181/169 |

*Primary Examiner*—James C. Cannon
*Attorney, Agent, or Firm*—Wegner & Bretschneider

[57] ABSTRACT

This is a vibratory diaphragm for a loudspeaker of sound appliances such as stereophonic phonographs or television receivers, which is made of composite material composed of polyimide resin, graphite granules and fabric of high strength and high modulus filaments. A vibratory diaphragm having well-balanced characteristics in the specific modulus, the internal loss, the mechanical strength, the thermal stability and the fatigue resistance is obtained. The polyimide resin gives high thermal stability, while the graphite granules greatly increase the internal loss. The fabric of high strength and high modulus filaments improves the specific modulus, the mechanical strength and the fatigue resistance.

20 Claims, 2 Drawing Figures

VIBRATORY DIAPHRAGM FOR LOUDSPEAKER

TECHNICAL FIELD TO WHICH THE INVENTION BELONGS

The present invention relates to a vibratory diaphragm for a loudspeaker. More particularly, it relates to a vibratory diaphragm for use in a loudspeaker of the sound appliances such as home stereophonic phonographs, autostereos, television receivers, radios or tape recorders.

BACKGROUND ART OF THE INVENTION

A vibratory diaphragm for a loudspeaker (hereinafter referred to as the "diaphragm"), so far, has mostly been made of paper. The principal reasons why paper diaphragm has widely been used are; that the raw material is easily obtainable, that relatively flat regenerating frequency characteristics can be obtained because of its high internal loss, and that an efficiency is high because it has low density and hence is light in weight. However, on the other hand, a paper diaphragm has disadvantages that a sound distortion generates and an upper regenerating frequency limit is low, because it has low specific modulus and begins a separation vibration at a relatively low frequency. Moreover, because paper easily absorbs moisture, the paper diaphragm has a disadvantage that sound quality is influenced by environments.

On the other hand, a metal diaphragm made of metal such as beryllium, boron or titanium has a feature that the upper regenerating frequency limit is high, because of the very high specific modulus compared with the paper diaphragm. However, because the metal diaphragm has very low internal loss, sharp peaks and dips appear in the regenerating frequency characteristics. Moreover, because such metals are inferior in malleability and ductility, they have disadvantages that it is difficult to form thin and to form in a cone- or dome-like.

Recently, in contrast with such paper and metal diaphragms, a diaphragm made of filament or fiber reinforced plastics (hereinafter referred to as the "FRP diaphragm") is beginning to be used in some loudspeakers. For example, in the specification of Japanese patent unexamined publication Nos. 59416/78 or 106026/78, an FRP diaphragm made of thermosetting resin such as phenolic or epoxy resin reinforced by carbon filament fabric is described.

This FRP diaphragm has a feature that the specific modulus and the upper regenerating frequency limit are high, because it employs carbon filaments having high specific modulus, especially in the form of fabric of continuous filaments. However, the internal loss is fairly small compared with the paper diaphragm, though it is larger than that of the metal diaphragm, so that sharp peaks and dips also appear in the regenerating frequency characteristics. Moreover, especially in loudspeaker of as high input power as more than several tens of watt, heat generation at the voice coil is so great that the temperature at a connection between the voice coil and the diaphragm will be as high as more than 200° C. In such a case, because the aforementioned conventional FRP diaphragm employs the resin of low heat-durability such as phenolic or epoxy resin, the specific modulus of the diaphragm drops and the upper regenerating frequency limit and a sound pressure level especially at high frequency area of the regenerating frequency characteristics, become lower. The same phenomena is more remarkable when used for a long time under the burning sun, as an autostereo or an autoradio.

On the other hand, in the specification of Japanese patent unexamined publication No. 158800/80, a diaphragm made of composite material composed of polyimide resin and graphite flakes is described. This diaphragm has the internal loss almost equal to that of the paper diaphragm and the specific modulus is also fairly high. Moreover, a drop of the regenerating frequency characteristics by heat is little matter unlike in the aforementioned FRP diaphragm, because the employed polyimide resin has a high heat resistance. However, the diaphragm has a rather fatal disadvantage for a diaphragm that the mechanical strength is low.

Namely, in order to obtain high specific modulus and large internal loss, this conventional diaphragm contains a lot of graphite flakes as much as about 30–90% by volume based on the whole volume. Therefore, the mechanical strengths, especially the bending strength and the impact strength, are very low. If the bending strength is low, the diaphragm cracks or in the worst case creaves for large relative displacement generated when each part of the diaphragm moves in different phases in the separation vibration area. Moreover, if the impact strength is low, the diaphragm generates cracks at a sharp rising-up sound, especially with large input power in lower frequency area.

Further, a diaphragm is generally made in a very thin form so that it is light and has a better efficiency. Usually it is formed in the shape of cone- or dome-like. Moreover, to improve the regenerating frequency characteristics, the ridges or the corrugations are often formed. So the detailed shape is fairly complicated though its shape is cone- or dome-like as a whole. However, a mixture composed of polyimide resin and a lot of graphite flakes has a poor moldability and tends to break in the manufacturing process. Even when the molding is successful, it is difficult to shape precisely and uniformly in detail. In other words, the diaphragm made of composite material of polyimide resin and graphite flakes lacks the equality and the uniformity in thickness. Thus, the mechanical strengths become much lower.

As mentioned above, conventional diaphragms have merits and demerits in various characteristics such as the specific modulus, the internal loss, the thermal stability, the mechanical strengths and the fatigue resistance which are all important for a diaphragm. Therefore, a diaphragm of well-balanced characteristics has been desired.

DISCLOSURE OF THE INVENTION

An object of the present invention is to provide a diaphragm of well-balanced characteristics required for a diaphragm, such as the specific modulus, the internal loss, the thermal stability, the mechanical strengths and the fatigue resistance.

Another object of the present invention is to provide a diaphragm of low distortion of sound with extinguished sound quality.

In order to achieve the above objects in accordance with the present invention, a diaphragm made of composite material composed of polyimide resin, graphite granules and fabric of high strength and high modulus filaments is hereby proposed. The diaphragm of the present invention has superior regenerating frequency characteristics, and has little drops of the characteristics and the sound quality with varying environments or when used for a long time.

THE BEST MODE TO CARRYING OUT THE INVENTION

A diaphragm of the present invention will be explained in detail hereinbelow.

A diaphragm of the present invention is made of composite material composed of polyimide resin, graphite granules and fabric of high strength and high modulus filaments. Namely, this diaphragm is a kind of FRP diaphragm made of mixture of polyimide resin and graphite granules uniformly dispersed in polyimide resin, which is reinforced by fabric of high strength and high modulus filaments. The mixture well enter into the interior of the textile structure of the fabric and the diaphragm substantially has no pores in it. The diaphragm is in the form of plate, cone- or dome-like. The ridges or the corrugations may sometimes be formed. The thickness of the diaphragm is about 0.02–0.7 mm and it contains fairly thinner range than that of the most widely used paper ones.

Next, the aforementioned polyimide resin, the graphite granules and the fabric will be explained.

Polyimide resin gives the desired shape to the diaphragm and principally improves the thermal stability and the mechanical strengths of the diaphragm. This polyimide resin is most preferably a homopolymer or copolymer of bismaleimide. As such polyimide is obtained through an addition polymerization, no volatile substance generates during molding process, and pores hardly remain in the diaphragm. Moreover, as the flowability at the molding is high, the dispersability of graphite granules and the imprepregnatability to the fabric are superior. Accordingly, the diaphragm with these materials is very uniform: an unevenness in the specific modulus, the mechanical strength and the internal loss is extremely reduced.

In the above, bismaleimide is, for example, N,N'-ethylene-bismaleimide, N,N'-hexamethylene-bismaleimide, N,N'-metaphenylene-bismaleimide, N,N'-paraphenylene-bismalemide, N,N'-p,p'-diphenylmethane-bismaleimide, N,N'-p,p'-diphenylether-bismaleimide or N,N'-p,p'-dicyclohexylmethane-bismaleimide. And compound which is copolymerized is, for example, polyamine such as 4,4'-diaminodiphenylmethane, condensation product of aniline and formaldehyde, 4,4'-diaminodiphenylether, 4,4'-diaminodicyclohexylmethane, 4,4'-diaminodiphenylsulphone, metaphenylenediamine or paraphenylenediamine, multi-functional cyanic acid ester such as cyanic acid ester of bisphenol-A or its oligomer, derivative of isocyanuric acid, vinyl compound, or epoxy compound.

Polyimide resin may be polymaleimideamine prepared from maleic acid and polyamine, polyamideimide prepared from tricarboxylic acid and polyamine, polyamideimide prepared from tricarboxylic acid, unsaturated dicarboxylic acid and polyamine, polyimide prepared from tetracarboxylic acid and polyamine (comprising polyimide which contain unsaturated bond such as vinyl or ethynyl group, as the end group). In the above, polyamine is, for example, 4,4'-diaminodiphenylmethane, condensation product of aniline and formaldehyde, 4,4'-diaminodiphenylether, 4,4'-diaminodiphenylsulfone, 4,4'-diaminodicyclohexylmethane, metaphenylenediamine or paraphenylenediamine. And tricarboxylic acid is, for example, trimellitic acid, 3,3',4-benzophenonetricarboxylic acid, 1,4,5-naphthalenetricarboxylic acid or 1,2,4-butanetricarboxylic acid. Further, unsaturated dicarboxylic acid is, for example, tetrahydrophthalic acid, 5-norbornene-2,3-dicarboxylic acid or methyl-5-norbornene-2,3-dicarboxylic acid. And tetracarboxylic acid is, for example, pyromellitic acid, 3,3',4,4'-benzophenonetetracarboxylic acid, 2,3,6,7-naphthalenetetracarboxylic acid, 3,3',4,4'-diphenyltetracarboxylic acid, 3,3',4,4'-diphenylmethanetetracarboxylic acid or 4,4'-hexafluoroisopropylidenebisphthalic acid.

The graphite granules mainly act to increase the internal loss and to improve the specific modulus of the diaphragm. Both natural and artificial graphite granules may be employed, while flake-like shape of 1–200 microns in an average diameter is preferable. If the average diameter is less than 1 micron, a sufficient increase in internal loss and an improvement in the specific modulus will be unexpectable. On the other hand, the graphite granules having an average diameter of more than 200 microns cannot disperse well in polyimide resin. When the mixture of the polyimide resin and the graphite granules is impregnated with the fabric, the fabric act as a kind of filter against the graphite granules. Therefore, if the diameter of the graphite granules is too large, only polyimide resin pass into the interior of the fabric and the graphite granules are apt to remain on the surface of the fabric. Then, the internal loss corresponding to the content of the graphite granules cannot be obtained. Moreover, if the graphite granules remain too much on the surface of the fabric, that part becomes brittle and a multiplied fabric tends to delaminate. Most preferable range of an average diameter is 5–50 microns.

The fabric mainly improves the specific modulus, the mechanical strengths and the fatigue resistance of the diaphragm. And the fabric is made of high strength and high modulus filaments such as carbon, glass or polyaramid filaments. The "filaments" in the present invention mean a bundle of single filaments having a diameter of 3–15 microns, that is multi-filaments. The fabric is usually made of one kind of filaments. However, it may be made of combination of two or more kinds of filaments: carbon and glass filaments, carbon and polyaramid filaments, glass and polyaramide filaments, or carbon, glass and polyaramide filaments.

Woven fabric is most prefarable because the filaments are straight and improvement in the specific modulus, the mechanical strengths and the fatigue resistance becomes higher. In that case, if the filaments largely crimp at the cross point of warps and wefts, the fabric increases in thickness and weight, and the specific modulus and the mechanical stengths of the diaphragm become lower, because the cone- or dome-like shaped fabric bends like a corrugated plate. In order to prevent this, the filaments are preferably fine; the cross sectional area is as small as 0.0003–0.1 $mm^2$.

The plain weave structure is most preferable for the fabric because it can be made thin and thus a light diaphragm is obtainable, and because, when formed to cone- or dome-like, dislocations take place regularly, if any, so that the specific modulus and the mechanical strengths of the diaphragm are uniform. However, the other structures such as twill or satin may also be employed. If the weave density is too low, the filaments separate from the mixture of the polyimide resin and the graphite granules. On the other hand, if it is too high, the mixture can hardly enter into the interior of the fabric. In both cases, the mechanical strengths of the diaphragm are apt to be low. Therefore, it is preferred that the weave density is about 3–40 filaments/cm. More preferably, it is 4–30 filaments/cm.

In the present invention, non-woven fabric may also be employed as fabric. Though the non-woven fabric is often composed of short fibers, an effect of improvement in the specific modulus and the mechanical strengths of the diaphragm is not as high as with the woven fabric, because the short fibers are discontinuous. Therefore, as will be mentioned later, in many cases, it is not employed alone but is employed together with the woven fabric. In case of the non-woven fabric using long filaments, this is not the case.

The fabric may be employed in a single ply or in multiplied sheets. In the latter, the fabric which is laminated may be of the same kind or different kind(s) of filaments. For example, in a three-layered structure consisting of carbon filaments (which has a relatively high specific modulus) covered on both sides of the center fabric of glass or polyarimid filaments (which has a relartively high internal loss), the potential merits of the individual fabric simultaneously appear. Moreover, the lamination of the different weave structures is also preferable. For example, in a three-layered structure consisting of woven fabric on both sides of the center non-woven fabric, the short fibers of the non-woven fabric move into the openings of the woven fabric so as to adhere firmly the two wovens: each layer hardly separate from each other and the mechanical strengths as well as the fatigue resistance of the diaphragm improve.

Next, the content of polyimide resin, the graphite granules and the fabric compared with the whole diaphragm will be explained.

Polyimide resin is the matrix material of the diaphragm as mentioned above and improves mainly the thermal stability and the mechanical strengths. For this purpose, its content is preferably more than 35% by volume. However, if it is too much, an effect of improvement in the specific modulus, the mechanical strengths and the fatigue resistance drops and an effect of increase in the internal loss is also reduced, for the relative content of the fabric and the graphite granules becomes lower. Therefore, it is preferred that the content is under 65% by volume.

If the graphite granules are over 5% by volume, the internal loss is improved fairly well: it increases proportionally up to about 30% by volume. However, if it becomes over 30% by volume, the increase is saturated, while it causes a poor dispersability. Accordingly, it is preferred that the content of graphite granules is 5–30% by volume.

Further, it is preferred that the content of the fabric is 20–50% by volume, though depending on the kind of the filaments, the form or the structure. Namely, if it is less than 20% by volume, an effect of improvement in the specific modulus, the mechanical strengths and the fatigue resistance of the diaphragm is small. And if it is over 50% by volume, the thermal stability and the internal loss remain unimproved, for the relative content of the polyimide resin and the graphite granules become lower.

Manufacture of the diaphragm of the present invention may be conducted as follows. After the mixture of the polyimide resin and the graphite granules, mixed in a desired composition ratio, is impregnated into the fabric, the resulted prepreg is put into a mold of the desired form such as cone-like and is pressed at an elevated temperature. If a belt-like farbic is impregnated with the mixture and is then supplyed to the molding machine, diaphragms will conveniently and commercially be manufactured.

As detailed above, the diaphragm of the present invention is made of composite material consisting of polyimide resin, graphite granules and fabric of high strength and high modulus filaments. The polyimide resin mainly improves the thermal stability and the mechanical strengths of the diaphragm, the graphite granules mainly increase the internal loss and improve the specific modulus, and the fabric improves the specific modulus, the mechanical strengths and the fatigue resistance. It is to be noted that they cooperate with each other. Accordingly, the diaghragm of the present invention can meet all requirements such as the specific modulus, the internal loss, the mechanical strength, the thermal stability and the fatigue resistance in a well-balanced manner, and any particular chracteristic is neither too high nor too low. Thus, with the diaphragm of the present invention, not only the low distortion and high sound quality but also a hard subject of keepig a good sound quality during a very long time in varying environments are now achieved.

EXAMPLE 1

Seventy-eight and a half weight parts of 4,4'-diaminodiphenylmethane bismaleimide and 21.5 weight parts of 4,4'-diaminodiphenylmethane were dissolved in 67.0 weight parts of N-methylpyrrolidone. The solution was then heated at 130° C. for 20 minutes. A 40% by weight solution of polyimide (copolymer of bismaleimide) having a viscosity of 20 poises at 23° C. was obtained.

Then, 70 weight parts of flake-like natural graphite granules CP, manufactured by Nippon Kokuen Co., Ltd., were added into 100 weight parts of the polyimide solution and stirred with a mixer for 1 hour. An average diameter of the graphite granules was about 7 microns.

The solution of polyimide containing the graphite granules was then impregnated to a plain weave fabric WE-116E of glass filaments, manufactured by Nitto Boseki Co., Ltd., by using a wire-bar coater. It was further heated for 20 minutes in a hot-air dryer maintained at 130° C., giving a prepreg of woven fabric. The thickness of the plain weave fabric of glass filaments was about 0.1 mm, and warp and weft densities were about 23 filaments/cm and 25.5 filaments/cm, respectively.

Two square sheets of 25×25 cm were cut out of the prepreg of the woven fabric, which were placed rectangularly so that the warp filaments of each sheet crossed at a right angle. The laminated sheets were put into a cone-like mold and maintained for 30 minutes under a pressure of 50 Kg/cm$^2$ at 200° C. Thus, a conical diaphragm of the present invention having about 121 mm in outer diameter, about 20 mm in inner diameter, about 26 mm in depth and about 0.22 mm in thickness was obtained. The diaphragm was composed of about 49% of polyimide resin, about 20% of graphite granules and about 31% of plain weave fabric of glass filaments, all by volume.

A loudspeaker was then obtained by adhereing a polyurethane sponge edge and a voice coil and by further equipping a frame to the diaphragm. Hereinafter, the loudspeaker is called as the EXAMPLE.

The EXAMPLE was then installed in a closed enclosure having an inner volume of 45 liters, where the regenerating frequency characteristics was measured according to Japanese Indutrial Standard JIS C 5531. The result is shown by a full line in FIG. 1. In FIG. 1, F in abscissa is an output sound pressure level and P in ordinate is a frequency.

For comparison, by using the solution of polyimide without graphite granules, a composite diaphragm made of about 61.2% of polyimide resin and about 38.8% of plain weave fabric of glass filaments by volume was prepared similarly. Further, a loudspeaker using the diaphragm was prepared likewise. Hereinafter, the loudspeaker is called as the COMPARATIVE. The loudspeaker was then installed in an enclosure where the regenarating frequency characteristics was measuered by the same condition as in the EXAMPLE. The result is shown by a dotted line in FIG. 1.

It is clear from FIG. 1, the regenerating frequency characteristics of the loudspeaker using the diaphragm of the present invention, namely the EXAMPLE, are very smooth with few sharp peaks and dips, compared with the loudspeaker using the diaphragm composed only of polyimide resin and the plain weave fabric of glass filaments, namely the COMPARATIVE. This shows that a considerable increase in the internal loss of the diaphragm is realized by the use of only such a small amount of graphite granules as 20 % by volume. Moreover, the upper regenerating frequency limit of the COMPARATIVE is much lower than the EXAMPLE. The upper regenerating frequency limit is a function of the specific modulus of the diaphragm, while the modulus mainly depends on fabric of glass filaments. Accordingly, it is presumed that there is some unexpected effect of graphite granules when they are used in addition of plain weave fabric of glass filaments, for both the EXAMPLE and the COMPARATIVE use fabric.

To confirm the above, test pieces of 2 cm wide and 10 cm long were cut from the material used in the EXAMPLE and the COMPARATIVE. Then, the internal loss and the sound speed which is an index of the specific modulus were measured with respect to the test pieces. The measurement was conducted by giving a free damping vibration to each test piece fixed at one end and observing it with an oscilloscope.

As the result of the measurement at room temperature, the internal loss of the EXAMPLE was about 0.030 and the sound speed was about 3800 m/sec. At 200° C., these values were about 0.049 and about 3550 m/sec., respectively. Namely, it is to be understood that both the internal loss and the sound speed are fairly high, even at a higher temperature. In contrast to this, the sound speed of the COMPARATIVE was about 3400 m/sec, a similar value compared with that of the EXAMPLE, but the internal loss was as small as about 0.006.

The bending strength of the same test pieces was then measured with Tention-bending Tester "AUTOGRAPH" IS-5000, manufactured by SHIMADZU CORPORATION, to give about 50 Kg/mm$^2$ for the test piece of the EXAMPLE, while for the test piece of the COMPARATIVE it was about 55 Kg/mm$^2$, a little less than that of the test piece of the EXAMPLE. However, this will be enough for practical use.

To determine how the above characteristics of the diaphragm of the EXAMPLE and the COMPARATIVE affect distortion characteristics, the second harmonic distortion was then measured by the method of Japanese Industrial Standard JIS C 5531, the result being shown in FIG. 2. In FIG. 2, F in abscissa and S in ordinate are the frequency and the second harmonic distortion, respectively. From FIG. 2, the second harmonic distortion of the EXAMPE shown by a full line is fairly better compared with that of the COMPARATIVE shown by a dotted line.

EXAMPLE 2

By the same method as in Example 1 but employing plain weave fabric #6142 of carbon filaments, manufactured by Toray Industries, Inc., a conical diaphragm composed of about 42.0% of polyimide resin, about 20.2% of graphite granules and about 37.8% of plain weave fabric of carbon filaments by volume was prepared. The thickness of this diaphragm was about 0.31 mm. The thickness of the plain weave fabric of carbon filaments was about 0.15 mm and the weave densities were about 8.9 filaments/cm in both warp and weft directions.

The internal loss, the sound speed and the bending strength measured by the same methods as in Example 1 with respect to this diaphragm were about 0.032, about 4100 m/sec and about 100 kg/mm$^2$, respectively.

Figure 1:
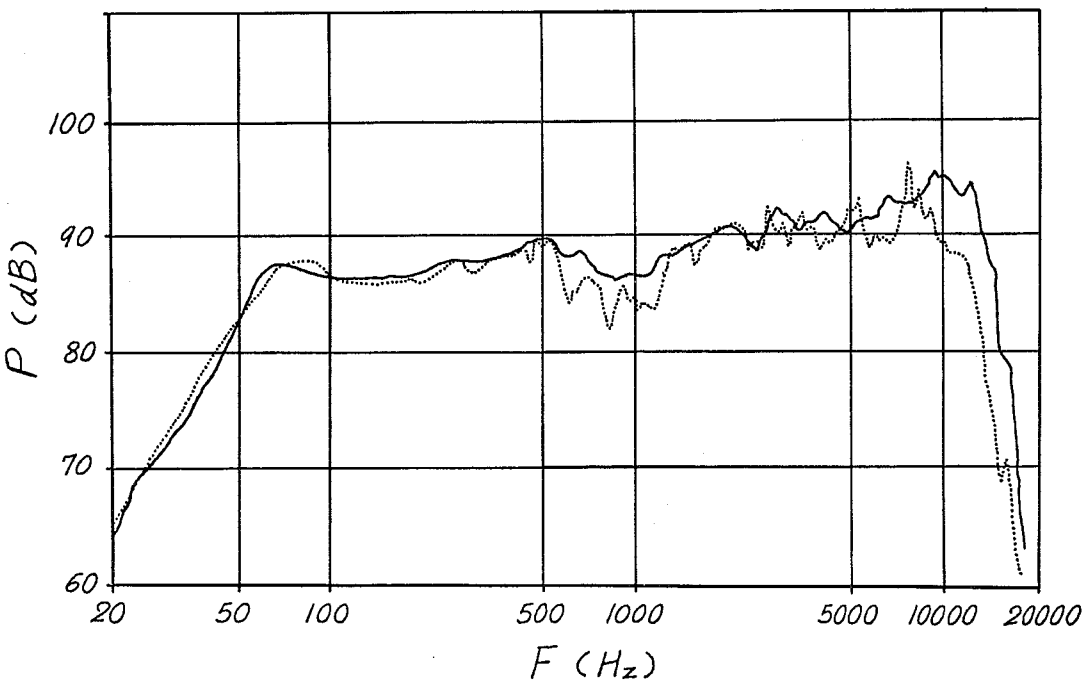
FIG. 1 shows the relationship between the regenerating frequency and the output sound pressure level of loudspeakers, employing a diaphragm of the present invention and a diaphragm made of composite material consisting of polyimide resin and plane weave fabric of glass filaments.
Figure 2:
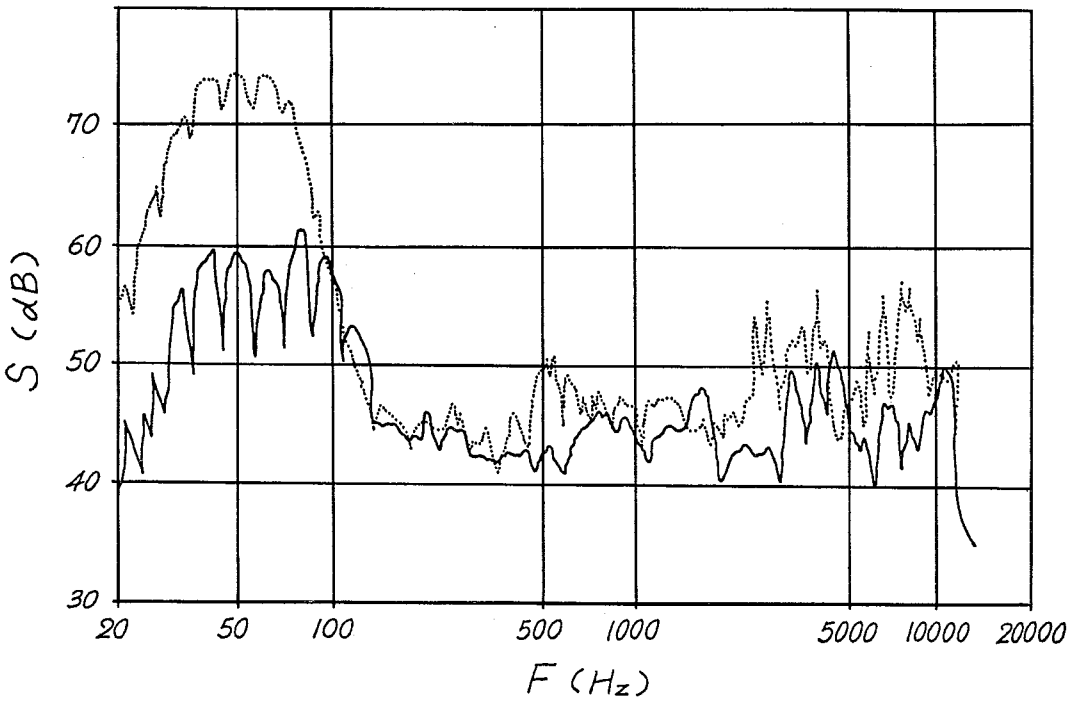
FIG. 2 shows the relationship between the regenerating frequency and the second harmonic distortion of loudspeakers using the aforementioned two kinds of diaphragms.

We claim:

1. A vibratory diaphragm for a loudspeaker made of composite material composed of polyimide resin, graphite granules and fabric of high strength and high modulus filaments.

2. A vibratory diaphragm for a loudspeaker as claimed in claim 1, wherein the thickness is 0.02–0.7 mm.

3. A vibratory diaphragm for a loudspeaker as claimed in claim 1, wherein the content of the polyimide resin is 35–65% by volume.

4. A vibratory diaphragm for a loudspeaker as claimed in claim 1, wherein the polyimide resin is a polymer of bismaleimide.

5. A vibratory diaphragm for a loudspeaker as claimed in claim 4, wherein the bismaleimide is N,N'-ethylene-bismaleimide, N,N'-hexamethylene-bismaleimide, N,N'-mataphenylene-bismaleimide, N,N'-paraphenylene-bismaleimide, N,N'-p,p'-diphenylmethane-bismaleimide, N,N'-p,p'-diphenylether-bismaleimide or N,N'-p,p'-dicyclohexylmethane-bismaleimide.

6. A vibratory diaphragm for a loudspeaker as claimed in claim 1, wherein the polyimide resin is a copolymer of bismaleimide.

7. A vibratory diaphragm for a loudspeaker as claimed in claim 6, wherein the copolymerized compound is 4,4'-diaminodiphenylmethane, condensation product of aniline and formaldhyde, 4,4'-diaminodiphenylether, 4,4'-diaminodicyclohexylmethane, 4,4'-diaminodiphenylsulfone, metaphenylenediamine, paraphenylenediamine, cyanic acid ester of bispehnol-A or their oligomer, derivative of isocyanuric acid, vinyl compound or epoxy compound.

8. A vibratory diaphragm for a loudspeaker as claimed in claim 6, wherein the bismaleimide is N,N'-ethylene-bismaleimide, N,N'-hexamethylene-bismaleimide, N,N'-metaphenylene-bismaleimide, N,N'-paraphenylene-bismaleimide, N,N'-p,p'-diphenylmethane-bismaleimide, N,N'-p,p'-diphenylether-bismaleimide or N,N'-p,p'-dicyclohexylmethane-bismaleimide, and the copolymerized compound is 4,4'-diaminodiphenylmethane, condensation product of aniline and formaldhyde, 4,4'-diaminodiphenylether, 4,4'-diaminodicyclohexylmethane, 4,4'-diaminodiphenylsulfone, metaphenylenediamine, paraphenylenediamine, cyanic acid ester of bisphenol-A or their oligomer, derivative of isocyanuric acid, vinyl compound or epoxy compound.

9. A vibratory diaphragm for a loudspeaker as claimed in claim 1, wherein the content of the graphite granules is 5–30% by volume.

10. A vibratory diaphragm for a loudspeaker as claimed in claim 1, wherein the average diameter of the graphite granules is 1–200 microns.

11. A vibratory diaphragm for a loudspeaker as claimed in claim 10, wherein the average diameter of the graphite granules is 5–50 microns.

12. A vibratory diaphragm for a loudspeaker as claimed in claim 1, wherein the content of the fabric is 20 –50% by volume.

13. A vibratory diaphragm for a loudspeaker as claimed in claim 1, wherein the fabric is woven fabric.

14. A vibratory diaphragm for a loudspeaker as claimed in claim 13, wherein the woven fabric is plane weave fabric, twill weave fabric or satin weave fabric.

15. A vibratory diaphragm for a loudspeaker as claimed in claim 13, wherein the woven fabric is made of at least one kind of filament selected from the group consisting of carbon, glass and polyaramid.

16. A vibratory diaphragm for a loudspeaker as claimed in claim 13, wherein the weave density of the woven fabric is 3–40 filaments/cm.

17. A vibratory diaphragm for a loudspeaker as claimed in claim 16, wherein the weave density of the woven fabric is 4–30 filaments/cm.

18. A vibratory diaphragm for a loudspeaker as claimed in claim 1, wherein the cross sectional area of the filament is 0.0003–0.1 $mm^2$.

19. A vibratory diaphragm for a loudspeaker as claimed in claim 1, wherein the fabric is non-woven fabric.

20. A vibratory diaphragm for a loudspeaker as claimed in claim 1, wherein the content of the polyimide resin is 35–65% by volume, the content of the graphite granules is 5–30% by volume and the content of the fabric is 20–50% by volume.

* * * * *